United States Patent [19]

Schall et al.

[11] Patent Number: 4,509,396

[45] Date of Patent: Apr. 9, 1985

[54] APPARATUS FOR MAKING HOLES IN THICK STACKS OF PAPER

[75] Inventors: Walter Schall; Guido Negro, both of Neuffen; Martin Hipp, Grossengstingen; Hans Albrecht, Neuffen, all of Fed. Rep. of Germany

[73] Assignee: Bielomatik Leuze GmbH & Co., Fed. Rep. of Germany

[21] Appl. No.: 490,194

[22] Filed: Apr. 29, 1983

[30] Foreign Application Priority Data

May 29, 1982 [DE] Fed. Rep. of Germany ..... 3220461

[51] Int. Cl.[3] ..... B26F 1/14

[52] U.S. Cl. ..... 83/126; 83/682; 83/685

[58] Field of Search ..... 83/126, 95, 92, 685, 83/682; 10/73, 78, 86 B

[56] References Cited

U.S. PATENT DOCUMENTS

| | | | |
|---|---|---|---|
| 247,465 | 9/1881 | Long | 83/126 |
| 384,532 | 6/1888 | Knowlton | 83/682 |
| 2,170,473 | 8/1939 | Fitch | 10/78 |
| 2,514,659 | 7/1950 | McClung | 83/126 |
| 3,320,843 | 5/1967 | Schott, Jr. | 83/685 X |
| 3,568,554 | 3/1971 | Wiechec | 10/78 X |
| 3,677,117 | 7/1972 | Cutter | 83/682 X |
| 3,863,534 | 2/1975 | Scott | 83/126 |
| 4,131,042 | 12/1978 | Rich et al. | 83/100 |
| 4,267,753 | 5/1981 | Bennett | 83/126 X |

FOREIGN PATENT DOCUMENTS

| | | |
|---|---|---|
| 1218277 | 6/1966 | Fed. Rep. of Germany . |
| 7332992 | 2/1973 | Fed. Rep. of Germany . |

*Primary Examiner*—Frank T. Yost

*Attorney, Agent, or Firm*—Steele, Gould & Fried

[57] ABSTRACT

A tool for punching relatively thick paper stacks, comprises a cylindrical, hollow punch with a cutting edge on its front outer edge. Processing takes place in the manner of a punching operation against a bearing surface, which has a hole corresponding to tool with a counterpunch arranged centrally therein. A blade is arranged in the resulting annular gap in order to separate punching waste which has been pressed into said annular gap and in order to permit the removal thereof.

7 Claims, 2 Drawing Figures

APPARATUS FOR MAKING HOLES IN THICK STACKS OF PAPER

BACKGROUND OF THE INVENTION

The present invention relates to an apparatus for making holes in a thick stack of paper. Such an apparatus is known from German Pat. No. 12 18 277. The apparatus used therein uses a hollow sleeve-like tool with a cutting edge located in the front area and which, on rotating, is used as a drill. This apparatus, which involves a considerable expenditure of force and correspondingly heavy loading of the paper, is relatively complicated, particularly if it is necessary to provide a plurality of closely juxtaposed, parallel holes. The drilling waste is in part considerably torn and harmful dilling dust is produced.

It has already been proposed to punch with piercing punches without involving any rotation. However, the process is slow and impossible to automate, because it is necessary to work against a soft waste paper substrate.

SUMMARY OF THE INVENTION

The object of the present invention is to provide a simple apparatus which, while having a simple construction, permits the piercing or punching of thick layers of paper.

According to the invention, this object is achieved by an apparatus for making holes in thick stacks of paper, comprising: first and second members mounted for relative movement toward and away form one another, said first member having a die surface for bearing the stack of paper and said second member having a punching tool non-rotatably fixed thereto, the punching tool having an inner bore and a sharp axially pointing cutting edge at its end, the bore communicating with a first discharge opening for cup-shaped cut-out waste parts formed during cutting; the die surface having an opening forming a cutting rim at the die surface; a counterpunch having a diameter corresponding to the bore in the punching tool, and disposed in the opening to form an annular gap between the cutting rim and the counterpunch; and, an annular removal path for cut-out annular waste parts which collect in said gap, the removal path communicating between said gap and a second discharge opening remote from said die surface, the removal path including means for retarding movement of the annular waste parts along said removal path, so as to form a self-renewing countercutting plug cooperating with the cutting edge of the tool, whereby, when said members undergo movement toward one another, the stack is first cut by the cutting edge of the punching tool alone, the cup-shaped cut-out waste being transported through the bore in the punching tool to the first discharge opening, and when cutting has progressed through the stack, the paper is then punched out between the rim of the die opening and the counterpunch forming cup-shaped and annular waste parts, the cup-shaped waste parts being transported through the bore of the cutting tool, while the annular waste parts are transported through the removal path.

When using the apparatus according to the invention, it is possible to punch in a completely satisfactory manner layers of paper having a thickness of approximately 25 mm, i.e. over 300 sheets, as a function of the paper quality. Thus, it is no longer necessary during the production of such a thick layer, to subdivide the same into several individual portions, which have to be separately punched and then combined again afterwards.

When using an apparatus according to the invention, the problem of punching waste naturally occurs but, unlike in conventional punching processes, it is not forced downwards through the die and is instead forced out through the hollow tool. However, as the internal tool bore has a much smaller diameter than the punching waste cut out by the cutting edge located on the outer circumference, such waste should theoretically lead to blockages. However, it has been found that in the case of the apparatus according to the invention, the punching waste is shaped into small cups and a strand consisting of numerous cup-shaped portions is conveyed through the hollow tool.

The circular tool cutting edge only cooperates with the die, if at all, during the final layers of sheets. It mainly cooperates with a "soft" countercut face, which is formed by the actual paper layers to be cut. This also applies in the vicinity of the annular clearance between die and counterpunch. In this area, due to the self-cutting action of the counterpunch, circular punching waste is cut out, which is forced downwards through the annular clearance, in which the circular cutting edge of the tool operates.

It has now been found that the apparatus works in a particularly advantageous and trouble-free manner, if said countercut face is constantly renewed, in that the circular punching waste is removed downwards. To this end cutting devices mainly cutting in the radial direction of the tool are preferably provided in the annular clearance between die and counterpunch. They separate the circular waste material, so that it can drop down from the counterpunch and consequently it is constantly possible to press downwards from above new such circular waste material.

Thus, with the apparatus according to the invention, part of the punching waste is subdivided into two portions, in that the first portion is cup-shaped and migrates upwards, while the remainder is removed downwards. The cutting means preferably comprises blades, which substantially radially bridge the annular clearance and which are arranged in spaced manner from the upper edge of the die. These blades and the shape of the annular clearance, which is either cylindrical or widens slightly in the downwards direction, determine the resistance to which the circular punching waste is exposed and consequently the cutting pressure opposing the blade in this area.

The operation of the tool is also improved if the counterpunch has a convex surface, which extends in the plane of the upper edge of the die or particularly somewhat over the latter in the direction of the stack to be punched. As a result of this construction, it is possible to assist the upwardly directed cup shaping of the waste, thereby facilitating the removal thereof.

BRIEF DESCRIPTION OF THE DRAWINGS

The invention is described in greater detail hereinafter relative to an illustrative embodiment shown in the drawings, wherein.

DETAILED DESCRIPTION OF THE EMBODIMENTS

Figures 1, 2:
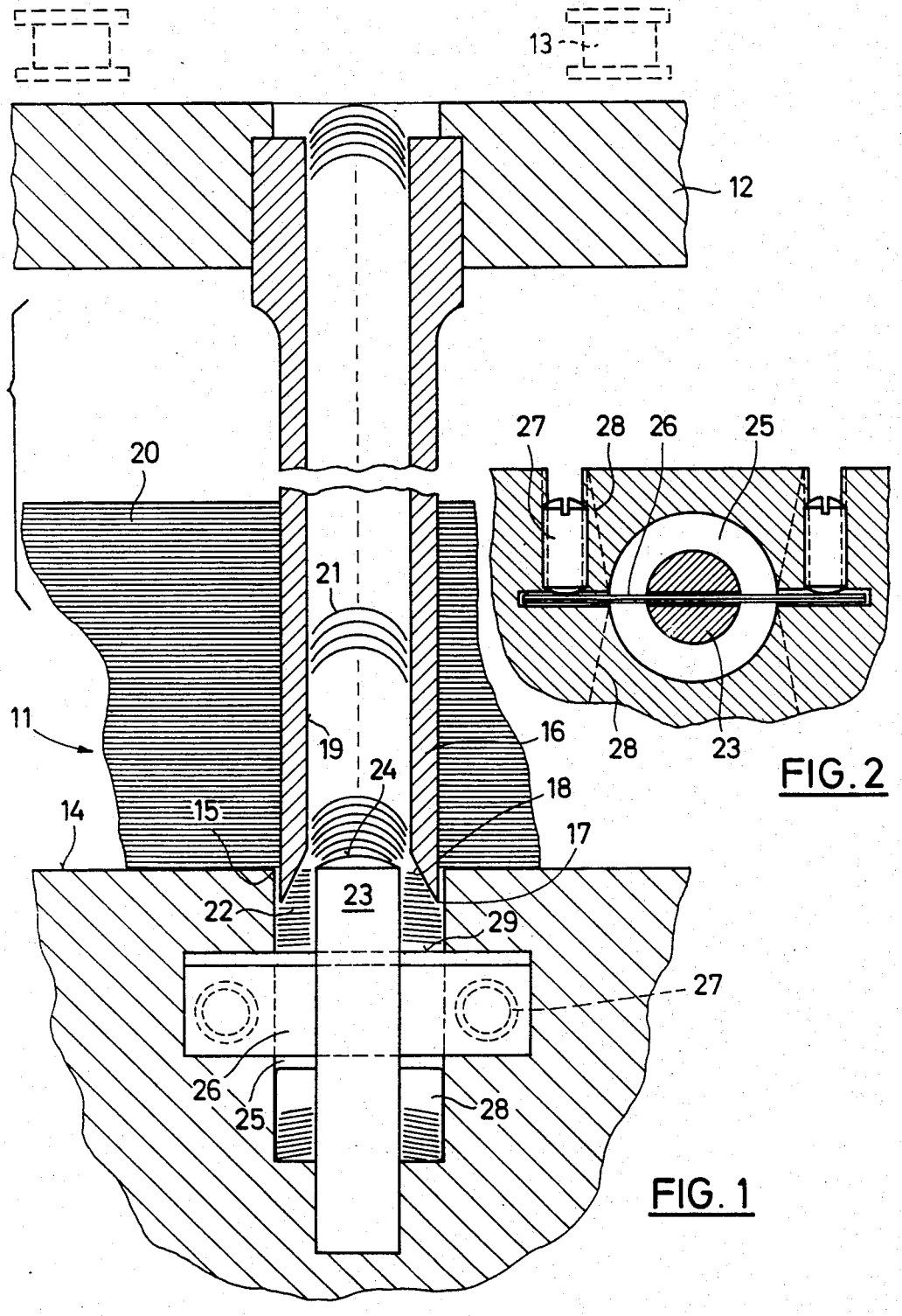
FIG. 1 is a partly broken away and partly diagrammatically indicated section through the apparatus, showing the essential part of the tool in a larger scale.
FIG. 2 is a section along line II—II of FIG. 1.

The apparatus 11 shown in the drawing comprises a yoke 12, which can be moved up and down with considerable force by a power device, for example a mechanical device or a hydraulic cylinder 13. A plurality of tools are fitted in juxtaposed, nonrotary manner to yoke 12 and are movable by the yoke in the direction of a bearing surface 14 for the stack of sheets 20.

Each tool 16 has a cylindrical sleeve-like configuration, is made from an extremely strong, hard steel and has on its front end face a circular cutting edge 17, which is located in the vicinity of the outer circumference of the tool and is connected to the tool bore 19 by a flat chamfer 18, which is as smooth as possible, is slightly upwardly widened and is as large as strength requirements permit. The external diameter of tool 16 corresponds to the desired diameter of the hole, which is generally, however, a multiple smaller than the thickness of stack 20 to be punched. Thus, for example, it is possible to make several holes of diameter 5 to 6 mm simultaneously in a stack approximately 25 mm thick.

For each tool, the bearing surface 14 has a circular recess, whose edge forms an all-around die edge or cutting edge. A counterpunch 23 is arranged in said bore with the same axis as tool 16 and its diameter is somewhat smaller than that of bore 19. The counterpunch extends into the bore of the bearing surface which, with its upper edge, forms the die edge 15 and is fixed to the apparatus base, i.e. the bearing surface 14, so that an annular clearance 25 is formed round the counterpunch.

The top of the counterpunch projects only slightly (less than 1 mm) over and beyond the bearing surface 14, where it is provided with a convex end face 24.

At a distance from the die edge 15 (4 to 5 mm), a blade 26 is provided in annular clearance 25 and projects diametrically through the counterpunch and annular clearance, while being fixed in the tool base, e.g. by fixing screw 27.

As can be gathered from FIG. 2, said blade subdivides the annular clearance into two halves. However, any other random arrangement of the blades is possible, e.g. in place of the arrangement of a single blade forming two separate cutting faces, the arrangement of several individually mounted blades, the arrangement of one or more than two blades, as well as a certain slope of the blades with respect to the axial direction or the diameter are workable.

A removal channel is provided below the blades.

The apparatus functions in the following way. After securing the paper stack 20, the tool is moved downwards and punches a hole corresponding to its external diameter. The cutting waste is thereby shaped in cup-like manner and passes out of the end of the tool, i.e. yoke 12 in the form of a strand of cup-like punching waste material 21. On reaching the lower end of the stack, the tool cutting edge 17 cuts into a tightly compressed stack of circular punching waste material 22, which has collected in annular clearance 25. This results from the fact that in the lower part of the cut, the inner edge of the tool also acts as a punch together with the counterpunch and consequently circular portions are produced there. The blade passes into annular clearance 25, but not sufficiently far to be in contact with blades 26. The latter are arranged at a good distance therefrom, so that a cushion of punching waste 22 is advantageously left between cutting edge 17 and cutting edges 29 of blades 26. However, during each working stroke of the tool, part of the punching waste 22 is subdivided into two halves by blade 26 and can consequently be removed by means of removal channels 28, which preferably extend forwards and rearwards, but can also consist of random openings.

The invention in particular makes it possible to simultaneously form in a stack, a plurality of very closely juxtaposed holes, such as is e.g. required for spiral bindings. The invention permits a higher operating speed than when drilling and it is also possible to simultaneously form closely juxtaposed holes.

The cutting process proceeds according to two automatically succeeding, continuously overlapping principles. At the start of each cutting process, i.e. in the upper part of the sheet stack 20, with its cutting edge 17, the tool cuts punching waste 21 in the form of round material disks having a diameter corresponding to cutting edge 17, which have a cup-like configuration and which migrate upwards through bore 19. In each case, the underlying portion of stack 20 forms the cutting edge support. Towards the end of the cutting process, the punching waste is subdivided into two portions, namely the disks or small cups 21 and the rings 22, which are punched out in conjunction between edges 15, the upper outer edge of the counterpunch 23 and tool 16. Thus, in this area the tool acts as a punching tool, which moves a material plug in front of it and cuts inwardly and outwardly by pressing into the annular clearance. The cut on the outer circumference is particularly clean due to the external cutting edge 17. This leads to the circular stack or plug of punching waste which forms a constantly renewed and self-adapting cutting edge support for the tool. As a result, it is possible to punch particularly thick layers with a non-rotary tool.

What is claimed is:

1. An appratus for making holes in thick stacks of paper, comprising:

first and second member mounted for relative movement toward and away from one another, the first member having a die surface for bearing the stack of paper and the second member having a punching tool non-rotatably fixed thereto, the punching tool having an inner bore and a sharp axially pointing cutting edge at its end, the bore communicating with a first discharge opening for cut-out cup-shaped waste parts which collect in the bore;

the die surface having an opening forming a cutting rim at the die surface;

a counterpunch having a diameter corresponding to the bore in the punching tool and disposed in the opening to form an annular gap between the cutting rim and the counterpunch; and, an annular removal path for cut-out annular waste parts which collect in the gap, the removal path communicating between the gap and a second discharge opening remote from the die surface, the removal path including means for retarding movement of the annular waste parts along the removal path, so as to form a self-renewing countercutting plug cooperating with the cutting edge of the tool, whereby, when said members undergo movement toward one another, the stack is first cut by the cutting edge of the punching tool alone, the cup-shaped waste parts being transported through the bore in the punching tool to the first discharge opening, and when cutting has progressed through the stack, the paper is punched out between the rim of the die opening and the counterpunch to form both waste parts, the cup-shaped waste parts being transported through the bore, and the annular waste parts being retardedly transported through the removal path.

2. An apparatus according to claim 1, wherein a cutting device substantially acting in the axial direction of tool is disposed in the annular gap.

3. An apparatus according to claim 2, wherein the cutting device comprises at least one cutting edge spaced from the die surface and substantially radially bridging the annular gap.

4. An apparatus according to claim 3, comprising two cutting edges on the circumference of the annular gap.

5. An apparatus according to claim 3, further comprising two cutting edges, substantially bridging the annular gap at two points.

6. An apparatus according to claim 1, wherein the counterpunch has a convex end face which projects somewhat beyond the bearing surface.

7. An apparatus according to claim 1, wherein the movement retarding means comprise walls in the first member defining the removal path.

* * * * *

UNITED STATES PATENT AND TRADEMARK OFFICE

CERTIFICATE OF CORRECTION

PATENT NO. : 4,509,396

DATED : April 9, 1985

INVENTOR(S) : Walter Schall, et al.

It is certified that error appears in the above-identified patent and that said Letters Patent is hereby corrected as shown below:

Column 2, line 32, "mainly cutting" should be --mainly acting--.

Column 3, line 2, before "EMBODIMENTS" insert --PREFERRED--.

Signed and Sealed this

*Fifteenth* Day of *October 1985*

[SEAL]

*Attest:*

DONALD J. QUIGG

*Attesting Officer*

*Commissioner of Patents and Trademarks—Designate*